United States Patent [19]

Carael et al.

[11] 4,288,522

[45] Sep. 8, 1981

[54] NON-PHOTOSENSITIVE RECEPTOR MATERIAL SUITED FOR PRODUCING BLACK-AND-WHITE SILVER IMAGES AND DYE IMAGES AND A PROCESS FOR THE PRODUCTION OF SUCH IMAGES THEREWITH

[75] Inventors: Frans Carael, Edegem; Daniël A. Claeys, Mortsel; Wilhelmus Janssens, Aarschot, all of Belgium

[73] Assignee: Agfa-Gevaert N.V., Mortsel, Belgium

[21] Appl. No.: 114,082

[22] Filed: Jan. 22, 1980

[30] Foreign Application Priority Data

Jan. 24, 1979 [GB] United Kingdom ..... 02551/79

[51] Int. Cl.[3] ..... G03C 5/54; G03C 1/40; G03C 1/48

[52] U.S. Cl. ..... 430/213; 430/214; 430/231; 430/233; 430/238; 430/247

[58] Field of Search ..... 430/213, 214, 215, 231, 430/233, 227, 247, 238, 237, 244, 248

[56] References Cited

U.S. PATENT DOCUMENTS

| | | | |
|---|---|---|---|
| 2,983,606 | 5/1961 | Rogers | 430/213 |
| 3,017,270 | 1/1962 | Tregillus et al. | 430/233 |
| 3,435,761 | 4/1969 | Weyerts et al. | 430/213 |
| 3,619,156 | 11/1971 | Parsons | 430/233 |
| 3,635,707 | 1/1972 | Cole | 430/226 |
| 4,047,952 | 9/1977 | Pfaff | 430/213 |

*Primary Examiner*—Richard L. Schilling
*Attorney, Agent, or Firm*—William J. Daniel

[57] ABSTRACT

Receptor material adapted for use in a combined dye transfer and silver complex diffusion transfer process, comprising in order:

(i) a support, (ii) a first hydrophilic colloid layer containing a cationic compound capable of mordanting an acid dye, and (iii) a transparent second hydrophilic colloid layer containing development nuclei for catalyzing the reduction therein of silver complex salts to silver and at least one organic compound having an anionic group linked to a carbon atom. The use of the receptor material for the production of a black-and-white silver image in combination with one or more dye images results in silver images of increased density.

11 Claims, No Drawings

NON-PHOTOSENSITIVE RECEPTOR MATERIAL SUITED FOR PRODUCING BLACK-AND-WHITE SILVER IMAGES AND DYE IMAGES AND A PROCESS FOR THE PRODUCTION OF SUCH IMAGES THEREWITH

The present invention relates to a non-photosensitive receptor material suited for use in the production of black-and-white silver images and dye images by the diffusion transfer process. The present invention also relates to a process for the production of a black-and-white silver image in combination with one or more dye images on this receptor material.

The production of multicolour images by diffusion transfer with specially adapted photographic silver halide emulsion materials is applied nowadays in several ways. Dye-diffusion transfer systems operating with silver halide as the light-sensitive substance are all based on the same principle, viz, the alteration in the mobility of a dye of dye-forming structural moiety controlled by the image-wise reduction of silver halide to silver. These systems are the basis for the production of instant colour prints in which the image is composed of several superposed monochrome dye images that form a multicolour print of the original multicolour scene or object.

In the graphic arts field, e.g. for colour proofing, carthography and technical illustrating, prints are required that mostly contain in addition to the monochrome dye images a black-and-white image in register with the colour information.

For that purpose the dye diffusion transfer process is used in conjunction with the common black-and-white silver complex diffusion transfer process which is based on the production of a silver image in a receptor material. The black-and-white image and the dye images are formed in register on the same registration material, which contains development nuclei for catalyzing the reduction of diffused silver complex salts to silver.

The diffused dyes or dyes formed from diffused dye-forming substances on the receptor sheet are usually fixed in a colloid layer by so-called mordants. In the dye diffusion transfer process, the mobility of the dye or dye-forming substance in hydrophilic colloid media is commonly obtained by the inclusion in their structure of an anionic group so that the mordant is generally a compound having a cationic structural part.

Particularly suitable dye-mordanting compounds for acid dyes are organic onium compounds as described, e.g., in the U.S. Pat. Nos. 3,173,786 of Milton Green, Newton Highlands and Howard G. Rogers issued Mar. 16, 1965, 3,227,550 of Keith E. Whitmore and Paul M. Mader issued Jan. 4, 1966, 3,271,147 of Walter M. Bush issued Sept. 6, 1966 and 3,271,148 of Keith E. Whitmore issued Sept. 6, 1966 which include quaternary ammonium compounds, tertiary sulphonium and quaternary phosphonium compounds that preferably contain a diffusion-hindering group e.g. a carbon chain of preferably at least 12 carbon atoms.

During research and experiment underlying the present invention it has been discovered that in diffusion transfer processes wherein silver images are formed in addition to dye images, the onium compounds acting as mordants for acid dyes have an inhibiting effect on the formation of the silver image and consequently on the optical density obtained by reducing silver complex salts in the presence of development nuclei.

The mechanism of that inhibiting effect is not quite understood but it is assumed that the onium compounds prevent the negatively charged silver-containing ions of the complex salt from reaching the development nuclei and block catalytic contact therewith.

In accordance with the present invention said problem of optical density reduction is solved by providing a non-photosensitive receptor material suited for use in a dye transfer and silver complex diffusion transfer process wherein the material contains:

(i) a support, (ii) a first hydrophilic colloid layer containing an organic onium compound capable of mordanting an acid-dye, and (iii) a transparent second hydrophilic colloid layer containing development nuclei for catalyzing the reduction of silver complex salts to silver;

and wherein the material also contains in layer (iii) and/or in a hydrophilic colloid interlayer between layers (ii) and (iii), at least one organic compound (hereinafter called anionic organic compound) having an anionic group linked to a carbon atom of said compound.

It is believed that the anionic organic compounds react with the onium compounds so that the latter are prevented from reacting with the silver complex anions.

Particularly effective anionic organic compounds are anionic organic surfactants, containing at least one sulphonate or sulphate group.

Examples of sulphonates are alkyl sulphonates, alkaryl sulphonates, alkylphenol polyglycol ether sulphonates, hydroxyalkane sulphonates, fatty acid tauride compounds and sulphosuccinic acid esters.

Examples of sulphates are primary and secondary alkyl sulphates, sulphated polyglycol ethers, sulphated alkylphenol polyglycol ethers and sulphuric acid esters of oils and fats.

Anionic surfactants and their chemistry of preparation are described by Warner M. Linfield in his book "Anionic Surfactants" Part II—Marcel Dekker, Inc., New York and Basel (1976). For the petroleum sulphonates see particularly p.330–335.

Preference is given to anionic organic compounds having in their molecular structure an uninterrupted carbon chain of at least 12 carbon atoms, as e.g. in a $C_{12}$–$C_{18}$ n-alkyl chain. Such compounds behave as surfactants or wetting agents.

Particularly good results have been obtained with commercial anionic organic surfactants such as AEROSOL OT (trade name of American Cyanamid Company, New York, N.Y., USA for a surfactant having the following structure:

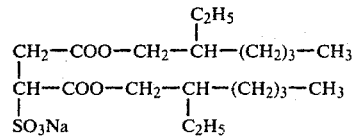

HOSTAPON T (trade name of Hoechst AG, Frankfurt/M, W-Germany, for a surfactant having the following structure:

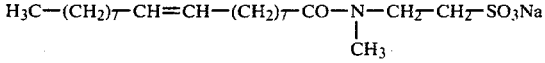

TERGITOL 4 (trade name of Union Carbide & Carbon, New York, N.Y., USA for a surfactant having the following structure:

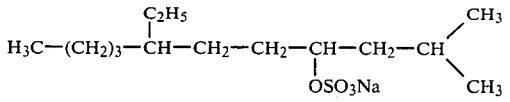

MERSOLAT H (trade name of Bayer AG, Leverkusen—W.Germany for a surfactant having the following structure:

$R—CH_2—SO_3Na$ wherein R is a linear alkyl chain of $C_{14}$–$C_{18}$ atoms.

SANDOZOL NE (trade name of Sandoz AG, Basel, Switzerland for a sulphonated butyl ricinoleate).

ULTRAVON W (trade name of Ciba—Geigy AG, Basel—Switzerland) for a surfactant having the following structure:

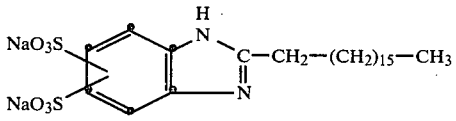

Other examples of anionic surfactants suitable for use according to the present invention can be found in U.S. Pat. Nos. 2,527,260 of John Alfred Henry Hart and Edward William Lee issued Oct. 24, 1950, 2,600,831 of Walter Dewey Baldsiefen issued June 17, 1952, 2,719,087 of William J. Knox, Jr. and Gordon D. Davis issued Sept. 27, 1955, 3,003,877 of Leonard T. McLaughin and Bill R. Burks issued Oct. 10, 1961, 3,026,202 of William J. Knox, Jr. and John F. Wright issued Mar. 20, 1962, 3,415,649 of Fumihiko Nishio, Yoshihide Hayakawa and Hideo Kawano issued Dec. 10, 1968, 3,788,850 of Arthur Henri De Cat, Francis Jeanne Sels, Robert Joseph Pollet and Josef Frans Willems issued Jan. 29, 1974, 3,788,851 of Josef Frans Willems, Francis Jeanne Sels, Robert Joseph Pollet and Arthur Henri De Cat issued Jan. 29, 1974, 3,788,852 of Francis Jeanne Sels and Robert Joseph Pollet issued Jan. 29, 1974, 3,793,032 of Robert Joseph Pollet, Marcel Cyriel De Fré and Arthur Henri De Cat issued Feb. 19, 1974, 3,963,499 of Keisuke Shiba, Hideki Naito, Nobuo Yamamoto and Masakazu Yoneyama issued June 15, 1976, UK Patent Specification Nos. 808,228 filed Aug. 16, 1956 by Ilford Ltd., 1,024,808 filed June 30, 1964 by Fuji Shashin Film, and 1,216,389 filed July 12, 1968 by Konishiroku Photo Industry Co. Ltd.

Anionic organic compounds suitable for use in receptor materials according to the invention also include anionic polymers, e.g. polystyrene sulphonate and anionic compounds that act as ultraviolet absorbers as described e.g. by G. F. Duffin in Photographic Emulsion Chemistry—The Focal Press—London—New York (1966), 167.

The present invention also includes a process wherein a diffusion transfer silver image and at least one dye transfer image are formed in a non-photosensitive receptor material, characterised in that the receptor material used is a receptor material as defined above.

The diffusion transfer process of silver image production is very well known in the art of photography. It involves the image-wise exposure and development of a photographic silver halide material and contact of such material with a receptor material in the presence of a silver halide complexing agent. Complexed silver halide transfers by diffusion to the receptor material and becomes transformed in such material to a silver image. The development of the latent image in the exposed silver halide material may precede or partly precede the contact of such material with the receptor material or it may take place while such materials are in contact.

In the process according to the invention, the formation of the diffusion transfer silver image may precede or succeed the formation of the transfer dye image(s) in the receptor material. A transfer dye image can e.g., as known per se, be produced by image-wise transfer of a dye, or by image-wise transfer of a dye producing compound, into the receptor material.

The silver image forming complex compounds, on the one hand, and the dye image-forming compounds on the other hand, may be transferred to the receptor material from different photographic materials which are successively brought into contact with the receptor material.

For the production of a dye image in the non-photosensitive receptor material, a photographic material having an image-dye-providing substance associated with a silver halide emulsion layer is used. The image-dye-providing substance is in that material initially mobile or initially immobile and undergoes an image-wise alteration in mobility in response to the image-wise reduction of image-wise developable silver halide. So, the image-dye-providing substance can be initially either diffusible or non-diffusible in the photographic material containing such substance when the material is permeated with the processing liquid used to carry out the dye diffusion transfer process. The non-diffusing substances are generally substances ballasted to give them sufficient immobility in the photographic material to prevent or substantially prevent their undergoing diffusion in the photographic material when it imbibes the processing liquid.

An image-dye-providing system that provides a positive transferred dye image in an image-receiving material, i.e. receptor material, in response to development of a conventional negative silver halide emulsion is called "positive working." An image-dye-providing system that provides a negative transferred image in an image-receiving material in response to development of a conventional negative silver halide emulsion is referred to as "negative working."

As described in the U.K. patent specification No. 804,972 filed Mar. 9, 1955 by International Polaroid Corporation corresponding with U.S. Pat. No. 2,983,606 of Howard G. Rogers issued May 9, 1961, dye developers (i.e. dyes that contain in the same molecule both a silver halide developing function and the chromophoric system of a dye) can be used to form positive colour-transfer images with a negative working silver halide emulsion layer. By reaction with developable silver halide the dye developer looses its diffusability in alkaline medium and unreacted dye developer is transferred to the receptor material and fixed thereon by the mordant.

According to another procedure for forming positive colour images on a receptor material, initially immobile compounds that release a diffusible image-providing dye are released in a way inversely proportionally to the silver image development as described, e.g., in the published German patent application (Dt-OS) No.

2,402,900 filed Jan. 22, 1974 by Eastman Kodak Company, in U.S. Pat. No. 3,980,479 of Donald Lee Fields, Richard Paul Henzel, Philip Thiam Shin Lau and Richard Allan Chasman issued Sept. 14, 1976 and in Research Disclosure 14,432 filed Apr. 1976.

In yet another procedure as described e.g., in Phot. Sci. Eng., Vol. 20, No. 4 July/Aug. (1976) 155–158, in U.S. Pat. No. 3,980,479 mentioned hereinbefore, and in the published German patent applications Nos. 2,645,656 filed Oct. 9, 1976 by Agfa-Gevaert AG, 2,242,762 filed Aug. 31, 1972 by Eastman Kodak Co., 2,505,248 filed Feb. 7, 1975 by Agfa-Gevaert AG and 1,772,929 filed July 24, 1968 by International Polaroid Corporation, dye images are produced in densities proportional to silver halide development so that the production in the receptor material of a positive dye image requires either the use of a positive-working emulsion i.e. one which acquires on development a silver image in the unexposed area, or, if conventional negative emulsions are used, the application of suitable reversal processes e.g. based on the silver complex diffusion transfer process as described e.g. in the U.K. patent specification No. 904,364 filed Sept. 11, 1958 by Kodak Limited at page 19 lines 1–41.

The amount of anionic organic compounds used in the development nuclei-containing-layer of the receptor material is related to the function of blocking the disadvantageous influence of the cationic mordants of the dye receptor layer on the optical density of the silver image and can be determined by simple tests. Normally amounts in the range of 2% to 100% by weight of anionic organic compound with respect to the onium mordant give satisfactory results e.g. 0.33 to 6.66 g per sq.m of anionic organic compound for about 10 g of onium mordant per sq.m is used. The amount of onium mordant is as conventional in dye diffusion transfer processes e.g. between about 15 and about 1 g per sq.m.

The binder of the silver image receiving layer as well as the binder of the dye image receiving layer is an organic hydrophilic binder, e.g. gelatin, carboxymethylcellulose, gum arabic, sodium alginate, propylene glycol ester of alginic acid, hydroxyethyl starch, dextrine, hydroxyethylcellulose, polyvinylpyrrolidone and polyvinyl alcohol.

It is preferred to use as development nuclei sulphides of nickel or silver or mixed sulphides thereof though other development nuclei can be used as well, e.g., sulphides of heavy metals such as sulphides of antimony, bismuth, cadmium, cobalt, lead and zinc. Other suitable nuclei belong to the class of selenides, polyselenides, polysulphides and tin(II) halides. The mixed sulphide salts of lead and zinc are active nuclei both alone and when mixed with thioacetamide, dithiobiuret and dithio-oxamide. Fogged silver halides can also be used as well as heavy metals themselves in colloidal form, preferably silver, gold, platinum, palladium and mercury. Both image-receiving layers may be hardened by conventional hardening agents so as to improve their mechanical strength. Suitable hardening agents for proteinaceous colloid layers include, e.g., formaldehyde, glyoxal, mucochloric acid, chrome alum.

In carrying out a process according to the invention, the required development nuclei can be formed in situ or applied in situ on the receptor material before contacting the image-wise photo-exposed material in the presence of a silver halide complexing agent with the receptor material. For example as described in the U.S. Pat. No. 3,617,276 of Louis Maria De Haes issued Nov. 2, 1971 the development nuclei can be applied in dispersed state from a carrier liquid which contains only an amount of hydrophilic colloid sufficient for maintaining the nuclei in dispersion.

When speaking of a silver image receiving layer that is transparent, there is meant that the layer is substantially free from any opacifying agent. Such does not exclude, however, the possibility to apply a light-reflecting layer containing e.g. titanium dioxide dispersed in a binder below the dye-receiving layer, i.e. between the support and the dye-receiving layer or on top of the silver image receiving layer containing the development nuclei, with the proviso that in the latter case the support is transparent and the light-reflecting layer is permeable to the processing liquid. A suitable light-reflecting layer composition comprising an opacifying agent, e.g. titanium dioxide in a vinyl polymer binder containing anionic solubilizing groups, is described in the U.S. Pat. No. 3,721,555 of Reichard W. Becker and Glen M. Dappen issued Mar. 20, 1978. The opaque light-reflecting layer containing titanium dioxide forms a white background against which the silver image and dye image(s) can be viewed. Such is interesting when polymeric film supports are used that inherently do not have an opaque reflecting structure.

Polymeric supports such as used in common silver halide photography are much more dimensionally stable than paper supports so that image transfer in precise registration on a receptor material with a polymeric base does not pose a problem. When a paper support is used, preference is given to a resin-coated one, e.g. polyethylene-coated paper, since it is much less moisture-sensitive and becomes dry to the touch more quickly in the wet diffusion transfer processing.

Details about the silver complex diffusion transfer process and image receiving layers therefor can be found in "Silver Halide Diffusion Processes" by A. Rott and E. Weyde—Focal Press—London/New York—1972, and are well known to those skilled in the art.

The following examples illustrate the present invention without, however, limiting it thereto. All ratios and percentages are by weight unless otherwise indicated.

EXAMPLE 1

Preparation of comparison receptor material A

In the preparation of the comparison receptor material A the dye image receiving layer containing a phosphonium compound as mordant was coated onto a transparent subbed polyethylene terephthalate from the following composition at a wet coverage of 65 g per sq.m:

| | |
|---|---|
| distilled water | 656 ml |
| gelatin | 72 g |
| aqueous 5% solution of $CF_3(CF_2)_8COONH_4$ as wetting agent | 10 ml |
| 8.8% solution of hexadecyl triphenyl phosphonium bromide | 250 ml |
| aqueous 4% solution of formaldehyde | 10 ml |

The hexadecyl triphenyl phosphonium bromide solution was prepared by dissolving 22 g of said compound in 100 ml of ethanol whereupon water was added up to 250 ml.

Onto the dried dye image receiving layer a silver image receiving layer was coated from the following composition at a wet coverage of 40 g per sq.m:

| | |
|---|---|
| distilled water | 903 ml |
| gelatin | 40 g |
| silver-nickel sulphide developing nuclei applied as a 0.20% colloidal dispersion in an aqueous 11.6% gelatin solution | 7 g |
| aqueous 5% solution of 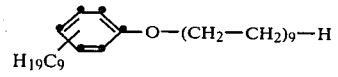 | |
| as non-ionic wetting agent | 40 ml |
| aqueous 4% formaldehyde solution | 10 ml |

The nuclei-containing layer was dried at 20° C.

Preparation of a receptor material B according to the present invention

The preparation of receptor material B proceeded as for the comparison material A except for the development nuclei containing layer, which was coated at a wet coverage of 48 g per sq.m from the following composition:

| | |
|---|---|
| distilled water | 1103 ml |
| gelatin | 40 g |
| the developing nuclei dispersion of the comparison material A | 7 g |
| aqueous 9.1% solution of 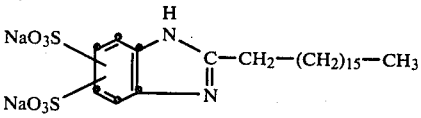 | 40 ml |
| aqueous 4% solution of formaldehyde | 10 ml |

Processing

The comparison receptor material A and the receptor material B according to the present invention were diffusion-transfer-processed under the same conditions with an unexposed light-sensitive negative type silver halide emulsion material COPYRAPID (trade mark of the Agfa-Gevaert N.V., Mortsel, Belgium).

The processing proceeded in a commercial diffusion transfer processing unit of the type described in FIG. 7.15 on page 255 of the book "Photographic Silver Halide Diffusion Processes" by André Rott and Edith Weyde—Focal Press—London—New York (1972).

The processing solution had the following composition:

| | |
|---|---|
| distilled water | 800 ml |
| hydroxyethylcellulose | 3 g |
| sodiumhydroxide | 15 g |
| benzylalcohol | 10 ml |
| paraformaldehyde | 1 g |
| sodiumthiosulphate (anhydrous) | 10 g |
| sodium bromide | 2 g |
| 1% solution in ethanol of 1-phenyl-2-tetrazoline-5-thion | 5 ml |

The silver image obtained in the receptor material A containing no organic anionic compound in the development-nuclei-containing-layer had a brown colour and the optical density measured with white light in a MACBETH (trade name) model TD-102 densitometer was only 0.14.

The silver image obtained in the receptor material B of the present invention was black and under the same measurement conditions as for the comparison material A had an optical density of 2.95.

The amount of silver determined on the comparison receptor material A was 0.120 g per sq.m, whereas the receptor material B according to the present invention contained 0.917 g of silver per sq.m.

After its separation from the photoexposed and developed silver halide emulsion material the receptor material may be treated with a stabilizing solution in order to prevent staining (yellowing) due to transferred developing agent. A stabilizing solution suited for that purpose comprises boric acid and polyethyleneimine dissolved in a mixture of ethanol and water.

EXAMPLE 2

The preparation of the receptor material B of example 1 was repeated with the difference, however, that the development-nuclei-containing-layer was coated from the following composition at a wet coverage of 48 g per sq.m.

| | |
|---|---|
| distilled water | 504 ml |
| gelatin | 40 g |
| dispersion of silver-nickel sulphide nuclei as described in Example 1 | 7 ml |
| 2% solution in ethanol of 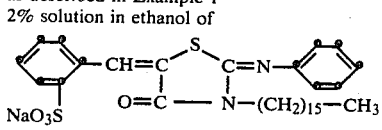 (anionic ultra-violet absorber) | 400 ml |
| aqueous 5% solution of 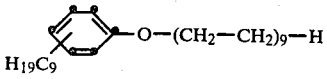 | 40 ml |
| aqueous 4% formaldehyde solution | 10 ml |

Improved results analogous to those described in Example 1 were obtained with this receptor material in comparison with the receptor material A of example 1.

EXAMPLE 3

The receptor material B on which a black-and-white silver image has been formed according to Example 1 was used as receptor material in combination with an image-wise exposed photosensitive dye diffusion transfer material M being composed as follows: a subbed water-resistant paper support consisting of a paper sheet of 110 g/sq.m coated at both sides with a polyethylene stratum of 15 g/sq.m was treated with a corona discharge and thereupon coated in the mentioned order with the following layers, the amounts relating to 1 sq.m of material:

(1) a silver precipitating layer containing after drying:

| | |
|---|---|
| silver sulphide nuclei | 20 mg |
| 1-phenyl-4-methyl-3-pyrazolidinone | 150 mg |
| magenta dye-releasing compound M3 (structural formula defined hereinafter) | 800 mg |
| gelatin | 2 g |

(2) a green-sensitive negative working gelatin-silver chloride emulsion containing 2.5 g of gelatin, 2.6 g of octadecylhydroquinone sulphonic acid and an amount of silver chloride corresponding with 1.1 g of silver;

(3) an antistress layer containing 2 g of gelatin.

The material M is image-wise exposed through a multi-colour transparency associated with a green filter.

After exposure the treated materials B and M were contacted to allow dye diffusion transfer in the COPYPROOF CP 38 (trade name) diffusion transfer processing apparatus containing a processing liquid composed as follows:

| | |
|---|---|
| sodium hydroxide | 15 g |
| hydroxyethylcellulose | 3 g |
| benzyl alcohol | 10 g |
| para-formaldehyde | 1 g |
| anhydrous sodium thiosulphate | 10 g |
| sodium bromide | 1 g |
| water up to | 1 l |

After a contact time of 2 minutes the receptor material B was peeled off the photographic material M and rinsed and dried. A magenta dye image was obtained in the mordanting layer of receptor material B, which contained already in the development nuclei layer a black-and-white silver image.

A photosensitive dye diffusion transfer material C was image-wise exposed and used in combination with the receptor material B already containing a silver image and the described magenta dye image.

The material C was composed as follows (the amounts being expressed per sq.m):

(1) a silver-precipitating layer containing after drying:

| | |
|---|---|
| silver sulphide nuclei | 0.02 g |
| 1-phenyl-4-methyl-3-pyrazolidinone | 0.15 g |
| cyan dye-releasing compound C3 (structural formula defined hereinafter) | 1 g |
| gelatin | 2 g |

(2) a red-sensitive, negative working gelatin-silver chloride emulsion containing 2.5 g of gelatin, 3.1 g of octadecylhydroquinone sulphonic acid and an amount of silver chloride corresponding with 1.3 g of silver;

(3) an antistress layer containing 2 g of gelatin coated in the indicated order to the above described paper support.

The image-wise exposure of material C proceeded as described for material M but through a red filter. The procedure of the dye transfer was the same as for material M. A cyan dye image was obtained in the mordanting layer of receptor material B which already contained in that layer a magenta dye image and a black-and-white silver image in the development nuclei containing layer.

A photosensitive dye diffusion transfer material Y was image-wise exposed and used in combination with the receptor material B already containing a silver image and said previously formed magenta and cyan dye images.

The material Y was composed as follows (the amounts being expressed per sq.m):

(1) a silver-precipitating layer containing after drying:

| | |
|---|---|
| silver sulphide nuclei | 0.02 g |
| 1-phenyl-4-methyl-3-pyrazolidinone | 0.15 g |
| the yellow dye-releasing compound Y3 (structural formula defined hereinafter) | 1 g |
| gelatin | 2 g |

(2) a blue-sensitive, negative working gelatin-silver chloride emulsion containing 2.5 g of gelatin, 3.6 g of octadecylhydroquinone sulphonic acid and an amount of silver chloride corresponding with 1.6 g of silver, and (3) an antistress layer containing 2 g of gelatin, coated in the indicated order to the above described paper support.

The image-wise exposure of material Y proceeded as described for material M but through a blue filter. The procedure of the dye transfer was the same as for material M and C. A yellow dye image was obtained in the mordanting layer of receptor material B which already contained a black-and-white silver image in the development nuclei containing layer and magenta and cyan dye images in the mordanting layer.

The same result was obtained by forming the dye images first and the black-and-white image as the last image on the same receptor material B.

Substantially the same results have been obtained by using instead of ULTRAVON W (trade name) in the same molar amounts the other commercial anionic organic surfactants defined hereinbefore in the description.

Compound M3

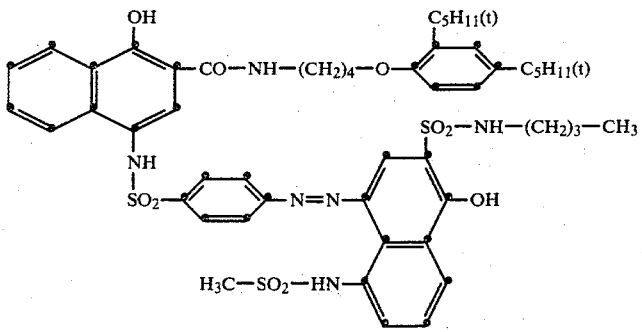

(prepared as described in published Dutch Patent Application 75/01348 filed February 5, 1975 by Eastman Kodak Co.)

Compound C3

-continued

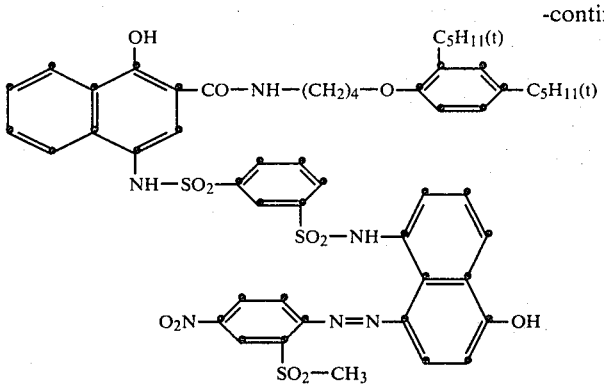

(prepared as described in U.S. Pat. Specification 3,929,760 of Richard A. Landholm, Jan R. Haase and James J. Krutak issued December 30, 1975).

Compound Y3

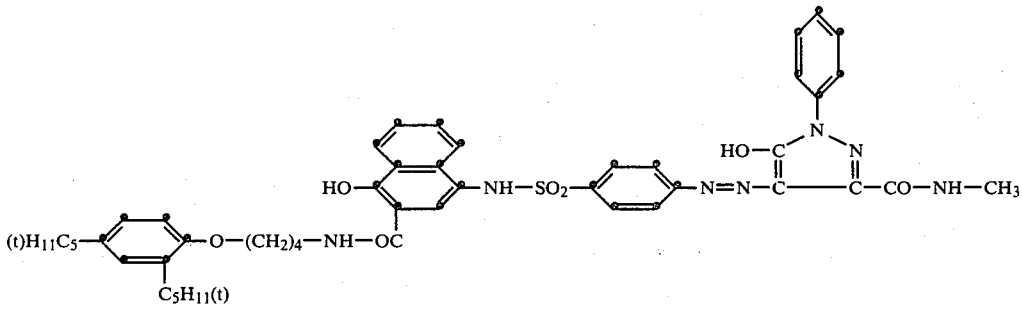

(prepared as described in U.S. Pat. Specification 3,929,760 mentioned hereinbefore).

We claim:

1. A non-photosensitive receptor material free from silver halide adapted for use in a dye transfer and silver complex diffusion transfer process, said material including:

(i) a support, (ii) a first organic hydrophilic colloid layer containing an organic onium compound capable of mordanting an acid dye, and (iii) a transparent second organic hydrophilic colloid layer containing development nuclei for catalyzing the reduction of silver complex salts to silver;

said material containing at least one organic compound having an anionic group linked to a carbon atom in said layer (iii) and/or in a hydrophilic colloid interlayer consisting essentially of a hydrophilic organic colloid binder and said organic compound which is situated between said layers (ii) and (iii).

2. Receptor material according to claim 1, wherein said organic compound is an anionic organic surfactant containing at least one sulphonate group or sulphate group.

3. Receptor material according to claim 2, wherein the anionic organic compound has in its structure an uninterrupted carbon chain of at least 12 consecutive carbon atoms.

4. Receptor material according to claim 1, wherein the anionic organic compound is a member selected from the group of alkylsulphonates, alkaryl sulphonates, alkylphenol polyglycol ether sulphonates, hydroxyalkane sulphonates, fatty acid tauride compounds, sulphosuccinic acid esters, primary and secondary alkylsulphates, sulphated polyglycol ethers, sulphated alkylphenol polyglycol ethers and sulphuric acid esters of oils and fats.

5. Receptor material according to claim 1 wherein said organic compound is present in said layer (iii) in an amount corresponding with 2% to 100% by weight with respect to the acid-dye mordanting compound that is present in said layer (ii).

6. Receptor material according to claim 1, wherein the cationic acid-dye mordanting compound is present in said layer (ii) in an amount of about 0.5 to about 5 g per sq.m.

7. Receptor material according to claim 1, wherein the development nuclei are sulphides of nickel or silver or mixed sulphides thereof.

8. Receptor material according to claim 1, wherein the support is a polymeric support carrying a light-reflecting layer.

9. In a process for producing a silver image and at least one dye image in a non-photosensitive receptor material by the steps of (1) image-wise exposing a photographic silver halide material comprising an image-dye-providing substance and a silver halide emulsion layer, (2) photographically developing said material, and (3) contacting the exposed material with a receptor material in the presence of a silver halide complexing agent, the improvement wherein said receptor material contains in the following order:

(i) a support, (ii) a first organic hydrophilic colloid layer containing an organic onium compound capable of mordanting an acid dye and, (iii) a transparent second organic hydrophilic colloid layer containing development nuclei for catalyzing the reduction therein of silver complex salts to silver, at least one organic compound having an anionic group linked to a carbon atom being present in said layer (iii) and/or in a hydrophilic colloid interlayer which consists essentially of a hydrophilic organic colloid binder and said organic compound and is situated between said layers (ii) and (iii), and then separating the exposed material from the receptor material so as to leave by diffusion-transfer a dye-image in said layer (ii) and a silver image in the development nuclei-containing layer (iii) of the receptor material.

10. A process according to claim 9, wherein the formation of the diffusion transfer silver image in the receptor material either precedes or follows the formation of each transfer dye image therein.

11. A process according to claim 9, wherein the development nuclei are produced in situ or applied in situ on the receptor material before contacting the exposed material with the receptor material in the presence of a silver halide complexing agent.

* * * * *